United States Patent [19]

Heinrich et al.

[11] Patent Number: 4,678,480

[45] Date of Patent: Jul. 7, 1987

[54] PROCESS FOR PRODUCING AND USING SYNGAS AND RECOVERING METHANE ENRICHER GAS THEREFROM

[75] Inventors: Peter Heinrich, Oberhausen; Klaus Knop, Geldern; Friedbert Rübe, Munich, all of Fed. Rep. of Germany

[73] Assignee: M.A.N. Maschinenfabrik Augsburg-Nürnberg AG, Fed. Rep. of Germany

[21] Appl. No.: 790,325

[22] Filed: Oct. 23, 1985

[30] Foreign Application Priority Data

Oct. 27, 1984 [DE] Fed. Rep. of Germany ..... 3439487

[51] Int. Cl.[4] ..... C10J 3/46; C10J 3/59; C22B 5/12

[52] U.S. Cl. ..... 48/197 R; 48/206; 48/DIG. 1; 75/35; 75/91; 252/373

[58] Field of Search ..... 252/373; 48/197 R, 203, 48/202, 206, DIG. 1; 75/35, 91; 55/26, 68

[56] References Cited

U.S. PATENT DOCUMENTS

| | | | |
|---|---|---|---|
| 1,800,856 | 4/1931 | Bradley | 75/35 |
| 2,113,774 | 4/1938 | Schnalfeldt | 48/DIG. 4 |
| 3,698,882 | 10/1972 | Garrett et al. | 48/197 R |
| 4,011,058 | 3/1977 | Johnson et al. | 48/197 R |
| 4,094,650 | 6/1978 | Koh et al. | 252/373 |
| 4,260,412 | 4/1981 | Summers et al. | 75/35 |
| 4,402,712 | 9/1983 | Benkmann | 252/373 |
| 4,521,221 | 6/1985 | Richter et al. | 55/25 |
| 4,556,421 | 12/1985 | Knop et al. | 75/91 |

FOREIGN PATENT DOCUMENTS 3,223,702 12/1983 Fed. Rep. of Germany .

*Primary Examiner*—Peter Kratz

*Attorney, Agent, or Firm*—McGlew and Tuttle

[57] ABSTRACT

A process for producing a synthesis gas containing methane and using a reactor having a fuel containing carbon comprises directing gasification gases in a circulation system through a bed of fuel containing carbon to form a synthesis gas containing methane and carbon dioxide. Thereafter, the synthesis gas is cooled in a regenerator and subjected to the gas separation wherein the syngas is subjected to a gas cleansing by means of a pressure change absorption in a gas scrubber to remove most of the methane and carbon dioxide and its water content is increased. The separated gas is then heated and subsequently the portion is returned into the system together with the waste gases and fuel containing carbon. The process includes a 4-pole heater which includes the first heat exchange passage for the syngas which is cooled and a second heat exchange passage for the recirculation of the syngas and is further cooled and passed through a scrubber. The system includes a heater which is arranged after the 4-pole heater which operates the gas and then the gas is passed through a reduction reactor back through a heating element of the regenerator that initially cooled the gas. A portion of the gas is also used to drive a steam turbine and to direct the excess steam from the turbine into the initial reactor which has a fluidized bed of the carbon material such as coal.

2 Claims, 1 Drawing Figure

PROCESS FOR PRODUCING AND USING SYNGAS AND RECOVERING METHANE ENRICHER GAS THEREFROM

FIELD AND BACKGROUD OF THE INVENTION

The present invention relates particularly to a process for the production of synthesis gas (syngas) where the gas produced in a reactor through the gasification of fuel containing carbon is cooled in a regenerator and subjected to treatment, and where part of the gas is recycled to the reactor together with fuel gas and fuel containing carbon, with the gas being heated in the regenerator before re-entering the reactor.

A process of this kind for the production of syngas is known from Applicant's German patent No. 3223702. This process is characterized by a low energy consumption, since the high temperature energy of the gas leaving the syngas reactor is used for the heating of the recyle gas before it re-enters the reactor.

Under the gasification conditions prevailing in the reactor this process produces a crude gas with a comparatively low hydrogen content and with virtually no methane at all. To improve the hydrogen content of the gas, it must be passed through a high temperature converter.

SUMMARY OF THE INVENTION

The present invention is based on the task of specifying a process for the production of syngas with a relatively high methane content which has a particularly low energy requirement and therefore can be implemented with high economy. Furthermore, the conversion stage is omitted in this process which is to provide syngas particularly well suited for the direct reduction of ore.

In the process according to the present invention, further cooling of the syngas in a 4-pole heat exchanger and a condenser during gas treatment is carried out while also treating the syngas in a gas scrubber for removing most of the methane and carbon dioxide, before it is admitted to a heater after having been reheated by passing again through the 4-pole heat exchanger, and at least part of the additional process steam produced in the heater is admitted to the gasification reactor.

In the process according to the present invention the crude gas, having passed through the regenerator, is cooled in the 4-pole heat exchanger and the condenser to below its dew point. The thermal energy withdrawn from the gas is not discharged, but is re-fed into the cycle at those points where it is required. This process is a simple way of producing high hydrogen syngas for the direct reduction of ore, while also obtaining methane as a most valuable by-product which can be used as syngas in chemical processes, such as for the production of methanol, or as fuel gas in other processes.

According to another alternative of the present process, the syngas is routed in such a way that after its first passage through the 4-pole heat exchanger it passes through the heater.

The process further provides for oxygen to be introduced as fuel into the gasification reactor, to improve the gasification reaction of the coal charged into the reactor, together with the process steam which is to increase the reactivity of the coal. It is of advantage for the energy balance of the process if part of the process steam excess energy is employed for the production of oxygen to be used in the reactor.

A typical example of the process covered by the present invention will now be detailed by reference to a flow sheet. The illustrated drawing is a block diagram of the plant for the production of syngas to be charged into an ore reduction reactor.

Accordingly it is an object of the invention to provide an improved method for producing synthesis gas containing methane which uses a reactor having a fuel containing carbon and which includes directing gasification gases in a circulating system through the bed of fuel containing carbon to form a synthesis gas containing methane and carbon dioxide and then cooling the syngas and subjecting the syngas to a gas separation with a portion of the gas which is separated being returned into the system together with the waste gases and the fuel containing carbon and a portion subjected to a gas cleansing by means of a pressure change absorption and a scrubber to remove most of the methane and carbon dioxide and the water content of the gas is increased.

A further object of the invention is to provide a system for processing syngas which includes a fluidized bed reactor containing coal into which gasification gases which include oxygen, steam and recirculated gases are directed and thereafter the syngases which are formed are directed through cooling elements to cool the gases through a scrubber for removing the methane and carbon dioxide with a portion being compressed and sent to a further heater in a reduction reactor and for eventual return into the system and another portion being used to generate steam in a system which uses a regenerator having separated hot and cold elements permitting an initial passage of the gas through the cooling elements and a subsequent passage through a heating element.

A further object of the invention is to provide an apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiments of the invention is illustrated.

DESCRIPTION OF THE PREFERRED EMBODIMENT

Figure 1:
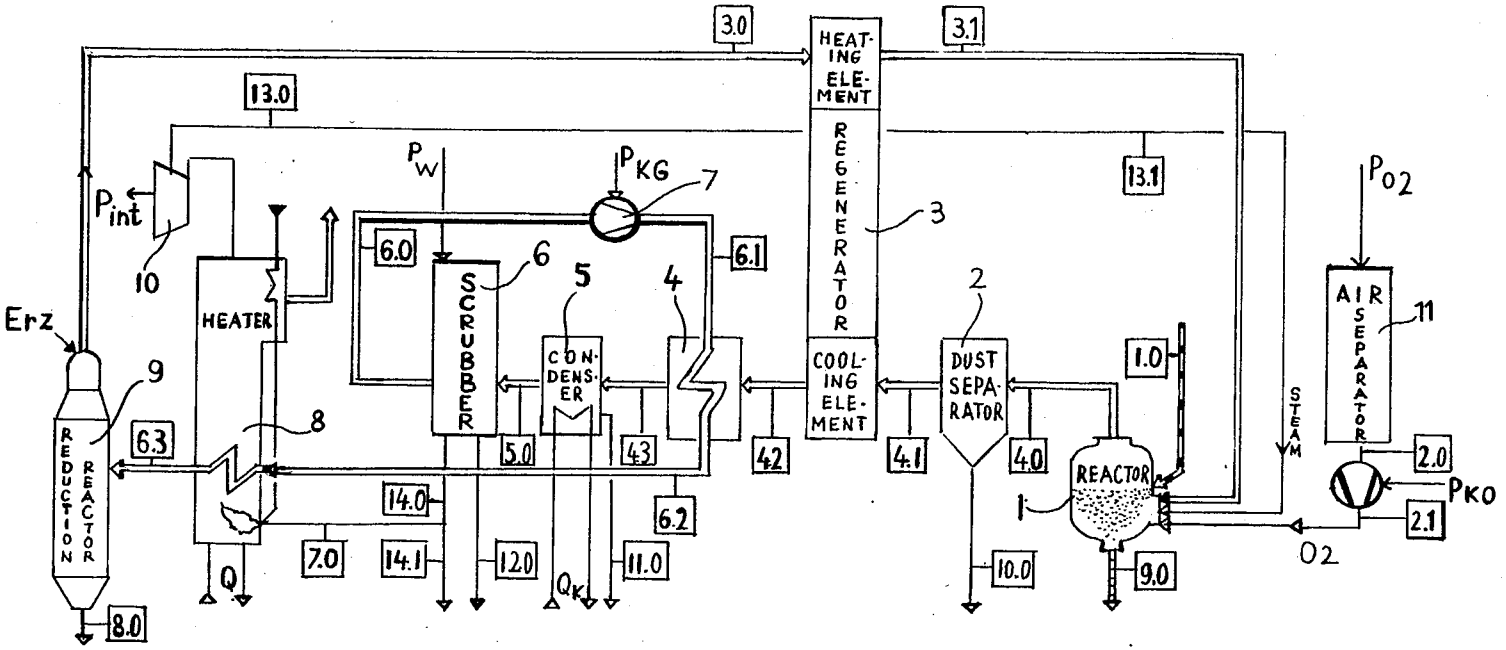
FIG. 1, is a schematic representation of a synthesis gas producing apparatus for the process of the invention.

Referring to the drawing in particular the invention embodied therein comprises a system for the process of producing a synthesis gas containing methane which uses a reactor 1 having a fuel containing carbon therein. The drawing also shows at various locations of the system in numerals which are enclosed in rectangular enclosures at locations of the portions of the system which are found in corresponding notations in the tables set forth in the present invention.

In accordance with the invention, gasification gases including oxygen, steam and waste gases are directed into the reactor 1 through a fluidized bed of a common material such as coal to produce synthesis gases which contain methane and carbon dioxide. The synthesis gases which are formed are then cooled in a cooling element of a regenerator 3 and thereafter subjected to a gas separation which occurs as the gases are passed through a 4-pole heat exchanger 4, a condenser 5 and a scrubber 6 and a return circulatin in which the gases again pass through another section of the 4-pole heater 4. A portion of the gases are directed through a heater 8 and a reduction reactor 9 and returned as gasification gases into the fluidized bed reactor 1. A 4-pole heat exchanger as shown at 4 in FIG.1, has two input pipes at 4.2 and 6.1 , and two output pipes at 4.3 and 6.2 , for a total of 4-pipes or poles.

According to the flow sheet, carbon in the form of fine-grain, reactive pulverized coal is charged into a fluidized bed reactor 1. High temperature process steam oxygen, and recycle gas are fed into the reactor 1 as gasification agents. The analysis of the recycle gas is given in Table No. 1, column 3.0

In the ractor 1 the coal is gasified at a temperature of 800° C. and a pressure of 10 bar. The ash during the gasification process is discharged at the reactor bottom. The synthesis crude gas leaves the reactor at the top with an analysis according to column 4.0 fo Table No 1.

Having passed through a flue ash or dust separator 2, the crude gas enters the cooling element of a regenerator 3 for being cooled from 800° C. to 578° C. Suitable regenerators which in a cooling element withdraw heat from a hot gas flow, while also storing the heat and transferring it via a heating element to another gas flow are known to the expert, amongst others, from blast furnace processes and the glass making industry, and are not, therefore , described in greater detail. Further cooling of the gas is provided in a 4-pole heat exchanger 4 and a condenser 5, reducing the gas temperature to 60° C. Any condensate obtained in the condenser 5 is drained.

Downstream the condenser 5 the gas is subjected to PSA scrubbing at 6 for the selective separation of the methane and carbon dioxide proportions of the syngas from the gas flow. The scrubbing process follows a well known absorption method according to which specific gases to be separated from a gas flow are absorbed by a solid matter, for being subsequently removed by means of a purging gas, such as nitrogen, after a flashing process. The separated methane and the carbon dioxide are sluiced out of the process for different uses.

The gas scrubber considerably increases the hydrogen content of the syngas, such as is shown in column 6.0 of Table No. 1. The syngas has now the very analysis required for subsequent ore reduction.

Downstream the gas scrubber 6, the syngas is fed into a compressor 7, after which it once again passes through the 4-pole heat exchanger 4 for being heated to 466° C. Before being admitted to the reduction reactor 9, the gas flow first passes through a heater 8 for the additional production of process steam required for the process and where through combustion of part of the methane separated in the gas scrubber 6 the syngas is heated to such a high lever that, having passed through the heater 8, it enters the ore reduction reactor 8 at a temperature of 900° C.

In the reduction reactor 9, where iron ore is directly reduced into sponge iron, the syngas is partly oxidized during the reduction process, upon which it leaves the reactor 9 with a lower hydrogen content, as shown in column 3.0 of Table no. 1. This gas, referred to as top gas, is admitted to the heating element of the regenerator 3 for being heated to 750° C. and the readmitted to then gasification reactor 1 as a high temperature recycle gas.

The high temperature water steam produced in the heater 8 is used for driving a steam turbine 10, with the turbine power output virtually covering all the electrical energy requirements of the process. Part of the turbine power is used in an air separation process at 11 for the production of oxygen such as is required for coal gasification. The oxygen is then compressed and fed into the gasification reactor 1.

The exhaust steam from the steam turbine 10 is admitted to the reactor 1 as process steam, having previously been heated to 750° C. in the regenerator 3. Heating the process steam in the regenerator 3 in addition to the top gas, means a further means improvement of the process energy balance. Of course, the top gas and process steam flows need not be routed in separate piping but can be combined before the inlet of the regenerator 3 for common heating.

TABLE NO. 1

| Process | Unit | Coal | Oxydant | | Top Gas | |
|---|---|---|---|---|---|---|
| Variable | | 1.0 | 2.0 | 2.1 | 3.0 | 3.1 |
| Volume Flow | $Nm^3/s$ | — | 1.815 | 1.815 | 34.05 | |
| | | | | | 37.93 | |
| Mass Flow Gas | kg/s | — | 2.585 | 2.585 | 20.71 | |
| | | | | | 20.38 | |
| Solid | kg/s | 6.23 | — | — | — | |
| Temperature | °C. | 20 | 20 | 450 | 402 | 750 |
| Pressure | bar | 10 | 1 | 10 | 10 | 10 |
| Gas Analysis | | | | | | |
| $H_2/CO$ | | — | — | — | 5.45 | |
| | | | | | 5.87 | |
| $H_2+CO$ | vol. % | — | — | — | 53.84 | |
| | | | | | 53.73 | |
| $H_2$ | vol. % | — | — | — | 45.49 | |
| | | | | | 45.91 | |
| CO | | — | — | — | 8.35 | |
| | | | | | 7.82 | |
| $CO_2$ | | — | — | — | 7.30 | |
| | | | | | 6.90 | |
| $H_2O$ | | — | — | — | 31.32 | |
| | | | | | 31.32 | |
| $CH_4$ | | — | — | — | 4.93 | |
| | | | | | 5.22 | |
| $H_2S$ | | — | — | — | 0.00 | |
| $N_2$ | | — | 2.0 | 2.0 | 2.61 | |
| | | | | | 2.83 | |
| $O_2$ | | — | 98.0 | 98.0 | — | |

| Process | Unit | Crude Gas | | | | Dry Gas |
|---|---|---|---|---|---|---|
| Variable | | 4.0 | 4.1 | 4.2 | 4.3 | 5.0 |
| Volume Flow | $Nm^3/s$ | 50.25 | | | | 43.81 |
| Mass Flow Gas | kg/s | 24.33 | | | | 29.84 |
| solid | kg/s | 0.32 | 0.0 | | | |
| Temperature | °C. | 800 | 800 | 578 | 358 | 60 |
| Pressure | bar | 10 | 9.5 | 9.2 | 8.9 | 8.5 |
| Gas Analysis | | | | | | |
| $H_2/CO$ | | 6.23 | | | | 6.23 |
| $H_2+CO$ | vol % | 59.21 | | | | 67.92 |
| $H_2$ | vol % | 51.03 | | | | 58.52 |
| CO | | 8.19 | | | | 9.39 |
| $CO_2$ | | 17.49 | | | | 20.06 |

| Process | Unit | Crude Gas | Dry Gas |
|---|---|---|---|
| Variable | | | |
| Gas Analysis | | | |
| $H_2O$ | | 14.99 | 2.49 |
| $CH_4$ | | 6.25 | 7.17 |
| $H_2S$ | | 0.09 | 0.10 |
| $N_2$ | | 1.97 | 2.26 |
| $O_2$ | | — | — |

Fuel

TABLE NO. 1-continued

| Process | Unit | Reducing Gas | | | | Gas |
|---|---|---|---|---|---|---|
| Variable | | 6.0 | 6.1 | 6.2 | 6.3 | 7.0 |
| Volume Flow | $Nm^3/s$ | 34.30 | | | | 1.746 |
| Mass Flow Gas | kg/s | 13.58 | | | | 1.356 |
| solid | kg/s | | | | | |
| Temperature | °C. | 60 | 86 | 466 | 900 | 60 |
| Pressure | bar | 80 | 100 | 10 | 10 | 10 |
| Gas Analysis | | | | | | |
| $H_2/Co$ | | 6.23 | | | | — |
| $H_2+CO$ | vol. % | 86.75 | | | | — |
| $H_2$ | vol. % | 74.75 | | | | — |
| CO | | 12.00 | | | | — |
| $CO_2$ | | 3.18 | | | | — |
| $H_2O$ | | 3.18 | | | | — |
| $CH_4$ | | 4.64 | | | | 88.66 |
| $H_2S$ | | 0.00 | | | | — |
| $N_2$ | | 2.31 | | | | 11.34 |
| $O_2$ | | | | | | — |

| Process | Unit | Sponge iron | Residual coke | Dust | Condensate | Gas Scrubber |
|---|---|---|---|---|---|---|
| Variable | | 8.0 | 9.0 | 10.0 | 11.0 | 12.0 |
| Volume Flow | $Nm^3/s$ | | | | | 7.76 |
| Mass flow gas | kg/s | | | | | 15.20 |
| solid | kg/s | 20.62 | 0.339 | 0.324 | 5.20 | |
| | | 8.0 | 9.0 | 10.0 | 11.0 | 12.0 |
| Temperature | °C. | 900 | 800 | 60 | 60 | 60 |
| Pressure | bar | | | | | 1.0 |
| Gas Analysis | | | | | | |
| $H_2/CO$ | | | | | | — |
| $H_2+CO$ | vol. % | | | | | — |
| $H_2$ | vol. % | | | | | — |
| CO | | | | | | — |
| $CO_2$ | | | | | | 89.14 |
| $H_2O$ | | | | | | 0.26 |
| $CH_4$ | | | | | | 0.59 |
| $H_2S$ | | | | | | — |
| $N_2$ | | | | | | — |
| $O_2$ | | | | | | — |

| Process | Unit | Process steam | | Excess gas (separated $CH_4$) | |
|---|---|---|---|---|---|
| Variable | | 13.0 | 13.1 | 14.0 | 14.1 |
| Volume flow | $Nm^3/s$ | 6.53 | | 1.764 | 0.0 |
| Mass flow gas | kg/s | 5.24 | | 1.356 | 0.0 |
| solid | kg/s | | | — | |
| Temperature | °C. | 350 | 750 | 60 | |
| | | 13.0 | 13.1 | 14.0 | 14.1 |
| Pressure | bar | | | 10 | 1.0 |
| Gas Analysis | | | | | |
| $H_2/CO$ | | | | — | — |
| $H_2+Co$ | vol. % | | | — | — |
| $H_2$ | vol. % | | | — | — |
| CO | | | | — | — |
| $CO_2$ | | | | — | — |
| $H_2O$ | | | | 100 | — |
| $CH_4$ | | | | — | 88.66 |
| $H_2S$ | | | | — | 0 |
| $N_2$ | | | | — | 11.34 |
| $O_2$ | | | | — | — |

| Given Process Data | | |
|---|---|---|
| Coal Analysis | wt. % | |
| C | 79.7 | |
| $H_2$ | 5.1 | |
| $O_2$ | 7.7 | |
| $N_2$ | 1.5 | |
| S | 1.1 | |
| Ash | 4.9 | |
| Water | 0.0 | |
| Net calorific value, $H_u$ waf | MJ/kg | 33.06 |
| $H_u$ real | MJ/kg | 31.44 |
| Energy $O_2$ production | $kWh/Nm^3$ | 0.42 |
| Non-combustible | 4.2 | |
| Gasification temperature | °C. | 800 |
| Gasification pressure | bar | 10 |
| Top gas temperature | °C. | 750 |
| Gas scrubber temperature | °C. | 60 |
| Gas scrubber pressure | bar | 8 |
| Process steam for gas scrubber | $kg/Nm^3$ | — |

TABLE NO. 1-continued

| | | |
|---|---|---|
| Electrical energy for gas scrubber | $kWh/Nm^3$ | — |
| Reduction temperature | °C. | 900 |
| Reduction pressure | bar | 10 |
| Degree of reduction, sponge iron | | 0.945 |
| Fe content in the ore | | 0.67 |
| Energy conversion in the gasifier | $MW_{+n}$ | |
| Coal | 201.8 | |
| Top gas | 322.3 | |
| Oxydant | 1.1 | |
| Process steam | 19.8 | |
| Total input | 545.0 | |
| Crude gas | 515.5 | |
| Losses | 29.5 | |
| Total discharge/output | 545.0 | |
| Correction for process steam | 5.0 | |
| Electrical energy consumption | $MW_e$ | |
| Air separation, $PO_2$ | 2.74 | |
| $O_2$ compressor, PKO | 0.96 | |
| Gas compressor, PKG | 1.50 | |
| Gas scrubber, PW | — | |
| Miscellaneous | 0.30 | |
| Total consumption | 5.50 | |
| Covered internally | 5.50 | |
| Covered externally | — | |
| Primary energy consumption/requirement | 206.8 MW | |

What is claimed is:

1. A method of producing and using a high quantity of high grade syngas with very little power consumption, and using a gasification reactor a fuel containing carbon materials and producing a methane plus carbon dioxide containing syngas as a product and also using a 4-pole heat exchanger having two inputs and two outputs, a condenser, a regenerator having a cooling element and a heating element, and a PSA scrubber, comprising: passing the syngas from the gasification reactor to the cooling element of the regenerator for cooling the syngas; passirg the cooled syngas into one of the inputs of the 4-pole heat exchanger and out through one of the outputs of the 4-pole heat exchanger for further cooling the cooled syngas; passing the further cooled syngas through the condenser for removing condensate from the further cooled syngas to produce a dry syngas; subjecting the dry syngas to scrubbing in the scrubber two remove separate portions of gas, one portion being high in methane and the other portion being high in carbon dioxide, and a hydrogen rich syngas leaving the scrubber; passing the hydrogen rich syngas through the other input of the 4-pole heat exchanger and out through the other output of the 4-pole heat exchanger for heating the hydrogen rich syngas to produce a heated hydrogen rich syngas subjecting the heated hydrogen rich syngas to a partial oxidation in an ore reduction reaction to produce a waste gas, passing the waste gas through a heating element of the regenerator for heating the waste gas, and supplying the heated waste gas to the gasification reactor to react with the fuel containing carbon material, and wherein the heated hydrogen rich syngas is supplied to a steam generating heater to be further heated thereby before the heated hydrogen rich syngas is supplied to the ore reduction reactor and supplying some of the one portion of gas which is high in methane, as fuel, to the steam generating heater for generating steam.

2. A method according to claim 1 including supplying some of the steam generated by the steam generating heater to the gasification reactor for reacting with the waste gas and with the fuel containing carbon material.

* * * * *